US005387140A

United States Patent [19]

Cunningham

[11] Patent Number: 5,387,140

[45] Date of Patent: Feb. 7, 1995

[54] FLOATATION APPARATUS FOR USE WITH ANY STANDARD BICYCLE

[76] Inventor: Bruce D. Cunningham, R.R. #1, Box 2035, Huntington, Vt. 05462

[21] Appl. No.: 280,347

[22] Filed: Jul. 25, 1994

[51] Int. Cl.[6] ..... B63H 16/20

[52] U.S. Cl. ..... 440/12; 440/29

[58] Field of Search ..... 440/11, 12, 13, 21, 440/26, 29, 27, 31, 30; 114/61, 144 R, 162

[56] References Cited

U.S. PATENT DOCUMENTS

| | | | |
|---|---|---|---|
| 577,269 | 2/1897 | Powley | 440/12 |
| 2,304,430 | 12/1942 | Triolo | 440/12 |
| 3,791,332 | 2/1974 | Gof | 440/30 |
| 3,954,079 | 5/1976 | Gof | 1.4/61 |
| 5,088,944 | 2/1992 | Kats | 440/26 |
| 5,224,886 | 7/1993 | Cunningham | 440/12 |

*Primary Examiner*—Stephen P. Avila
*Attorney, Agent, or Firm*—Thomas N. Neiman

[57] ABSTRACT

The floatation apparatus for use with any standard bicycle (either single or tandem unit) a catamaran or pontoon hull with a tubular structure to support a standard bicycle. The front wheel of the bicycle will be removed and the front fork will be attached to a support that is connected to the directional control system in order to provide a steering mechanism. The novel steering mechanism has the fork connected to a steering control pulley. An adjustable line is connected to the steering control pulley on one end and wraps around a steering pulley that is attached to the rudder at the rear of the apparatus. By reversing the direction of the steering control lines and passing them around a number of idler pulleys, the operator will turn the apparatus in the direction he or she turns the bicycle's handle bars. The rear wheel of the bicycle will rest on a rotating drum that will provide power to a drive propeller. The direction and the power for the apparatus is provided by a unique combined propeller/rudder unit whose thrust and steering direction is controlled by the bicycle handle bars. The bike will be kept in an upright position by a support yoke which will allow the rear wheel of the bicycle to rotate. The hull or hulls of the apparatus will be of sufficient length and width to provide stability for the apparatus in rough water conditions.

8 Claims, 4 Drawing Sheets

FLOATATION APPARATUS FOR USE WITH ANY STANDARD BICYCLE

BACKGROUND OF THE INVENTION

This invention pertains to floatation devices, and, in particular, to a floatation apparatus that is designed to be used with any standard bicycle to allow an individual to have a self propelled water vehicle that can be easily assembled or disassembled for use as desired.

Many millions of people in the United States and around the world ride bicycles on a regular basis. Fewer people own water craft with which to have boating activities on a regular basis. What is needed is an apparatus that will permit an individual to easily convert any standard bicycle to a self propelled water vehicle by attaching it to a floatation device.

There have been a number of attempts to creating flexibility in floatation apparatus. A pair of United States patents issued to Mohammed S. Gof on Feb. 12, 1974, U.S. Pat. No. 3,791,332 for a Water Bike shows a bike having a pair of passenger carrying side boats and on May 4, 1976, U.S. Pat. No. 3,954,079 for a Dual Hull Water Bicycle. Applicant also has an issued U.S. Pat. No. 5,224,886. Clearly, it is desirable for an apparatus of this type to be very lightweight and flexible. At the same time, the apparatus should be easy to install and be extremely simple to attach to floatation apparatus and, at the same time, be able to use any standard bicycle. Another object of this invention is to provide an apparatus that has an ease of manufacture and ease of assembly. It is also the object of this invention to teach an improved directional control system and drive system for the above-identified apparatus.

It is an object of this invention to set forth an improved floatation apparatus which avoids the disadvantages, limitations, above-recited, obtained from prior floatation apparatus.

SUMMARY OF THE INVENTION

Particularly, it is the object of this invention to set forth a floatation apparatus for use with any standard bicycle, for use in allowing an individual the ability to have a self propelled water craft comprising floatation means; said floatation means comprising means with sufficient area of buoyancy to allow a standard bicycle and rider to maintain their balance on the surface of the water; said floatation means having frame means for permitting said bicycle to have a support base; said frame means comprising means for attaching a bicycle frame to said floatation means; said base support plate having an adjustable support frame connected to said base support plate; said adjustable support frame having guide tracks positioned on said floatation means for allowing said adjustable support frame to slide into the desired position to receive said bicycle frame; said adjustable support frame further having quick release means; said frame attaching means having bicycle fork receiving means; said bicycle fork receiving means comprising an adjustable angled tubular frame; said adjustable angled tubular support means having locking means; said frame means further having directional control means; said directional control means comprising a steering control pulley; said directional control means further comprising adjustable line means connected to said steering control pulley; said frame means further having drive means; said drive means comprising means for receiving the rear wheel of a bicycle; said wheel receiving means comprising rotatable drum means for permitting said rear wheel of said bicycle positioned on said rotatable drum and allow free rotation of said rear wheel; said rotatable drum means having transmission means; said transmission means comprising belt means; said transmission means further comprising pulley means; said drive means having a propeller contacting said transmission means through a flexible shaft means; and said flexible shaft means having both said transmission pulley means and said steering control pulley of said directional control means positioned on said flexible shaft means.

BRIEF DESCRIPTION OF THE INVENTION

Further objects and features of this invention will become more apparent by reference to the following description taken in conjunction with the accompanying figure, in which.

DESCRIPTION OF THE PREFERRED EMBODIMENTS

Figure 1:
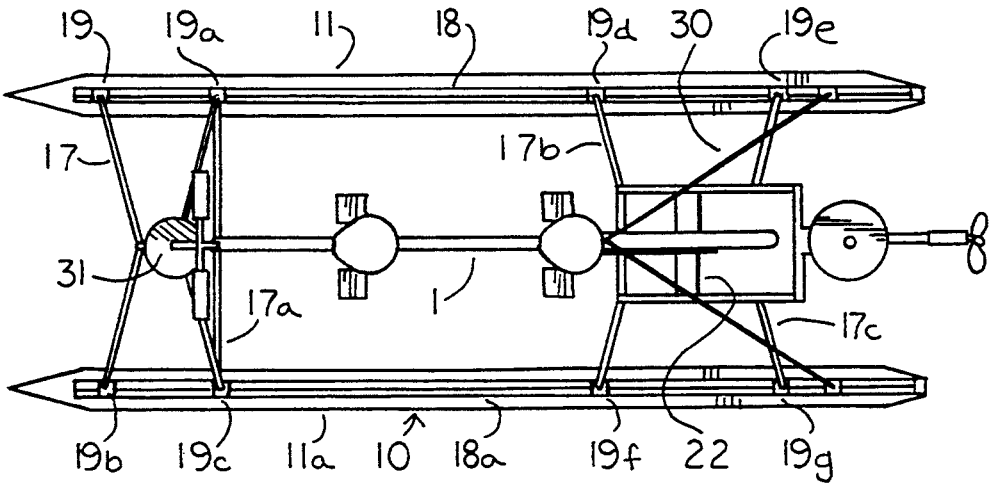
FIG. 1 is a top plan view of the novel floatation apparatus.
Figure 2:
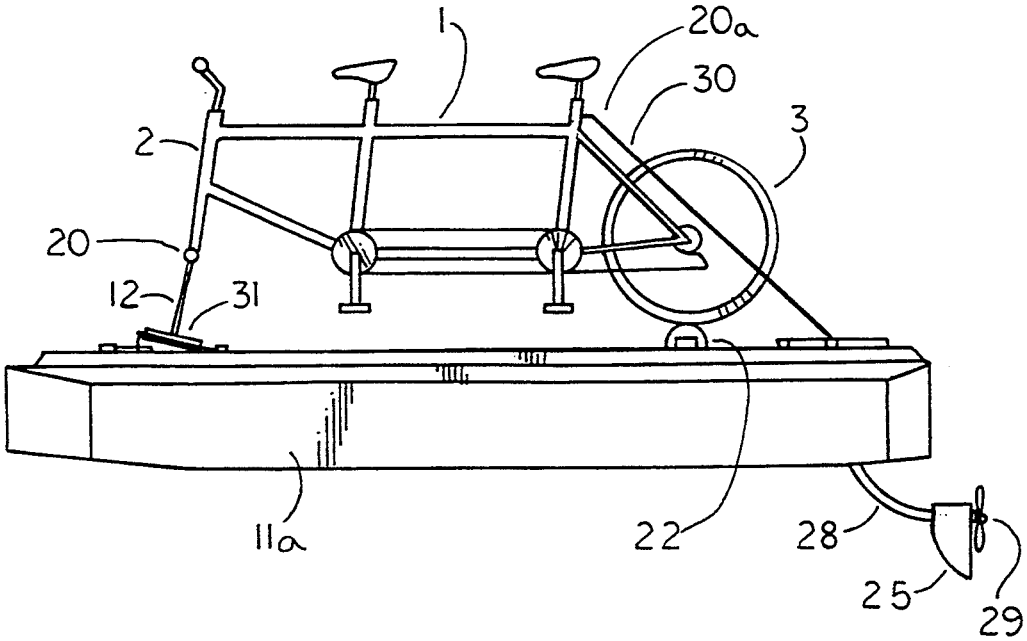
FIG. 2 is a side elevational view thereof.
Figure 3:
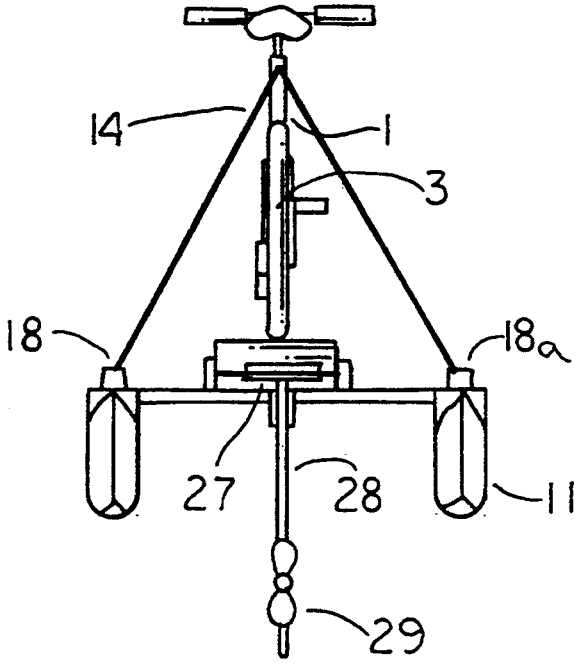
FIG. 3 is a rear elevational view thereof.
Figure 4:
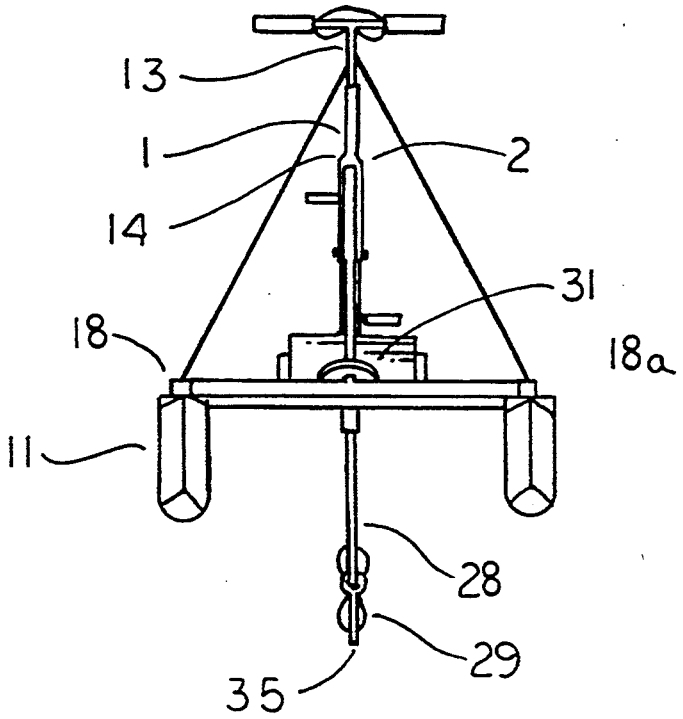
FIG. 4 is a front elevational view thereof.
Figure 5:
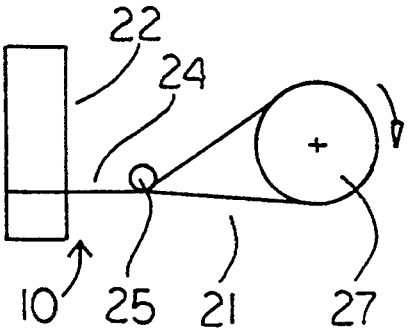
FIG. 5 is a top schematic view of the novel drive system of the novel floatation apparatus.
Figure 6:
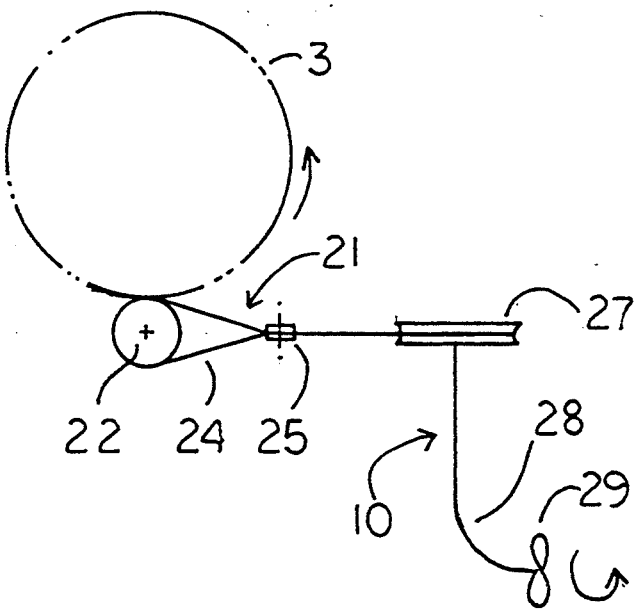
FIG. 6 is a side schematic view thereof.
Figure 7:
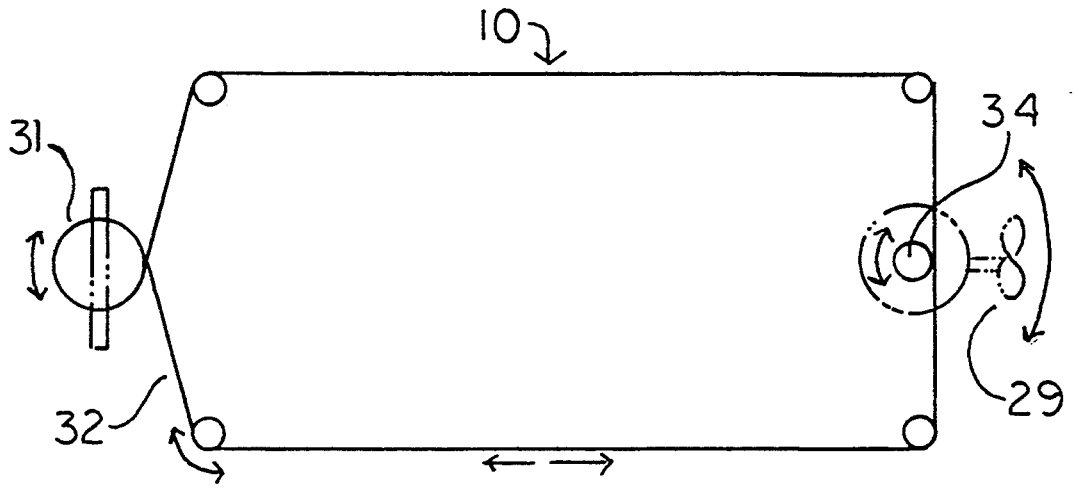
FIG. 7 is a top schematic view of the novel directional control system of the novel apparatus.
Figure 8:
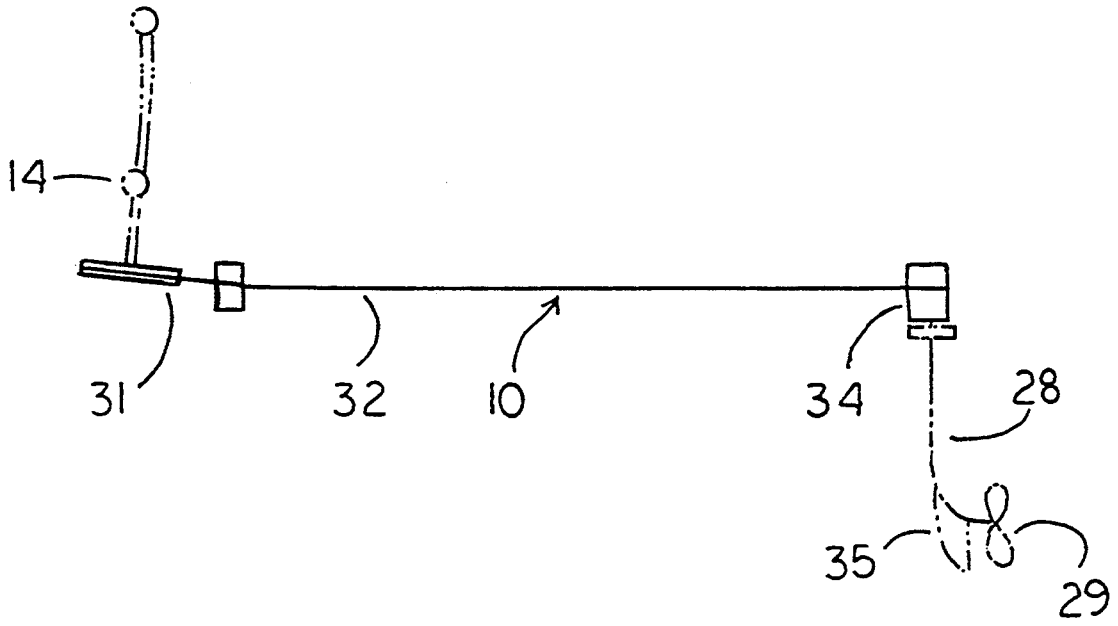
FIG. 8 is a side schematic view thereof.

As shown in the figures, the novel floatation apparatus 10 comprises a catamaran or pontoon hulls 11 and 11*a* that is sized to provide sufficient buoyancy to support a standard bicycle and rider on the water's surface with the balance required for stability. The front wheel of the bicycle 1 is removed and the front fork 2 of the bicycle will attach to a fork support frame 12 which comprises an angled tubular structure. The stem 13 of the fork support frame 12 extends downward through bearings 14 and is attached to the steering control pulley 31. An adjustable line 32 connects the steering control pulley 31 and the driven steering control pulley 34 located at the rear of the apparatus 10. Therefor, when the user turns the handle bars a small amount, the entire flexible drive shaft 28 and the propeller 29 will turn the apparatus in a corresponding direction. Turning the handlebars about sixty degrees will cause the craft to move in a reverse direction. A plurality of stability rods 17, 17*a*, 17*b* and 17*c* support the bike and fit in guide tracks 18 and 18*a* located on the hulls. The purpose of the guide tracks is to be able to adjust the drive and the fork support frame for varying sized bicycles. A number of quick release clamps 19, 19*a*, 19*b*, 19*c*, 19*d*, 19*e*, 19*f* and 19*g* allow the directional control mechanism and the drive mechanism to be quickly attached to or released from the pontoons to facilitate transporting the device on land. Tightening locks 20 and 20*a* allow the bicycle to be quickly attached or quickly released from the floatation apparatus.

The drive mechanism assembly 21 of the apparatus 10 comprises a rotating drum 22 that is positioned between the hulls on support rods and bearings. The drive mechanism assembly 21 is also mounted on tracks 18 and 18*a* so that the entire assembly with the bicycle attached may be adjusted fore and aft to level the craft in the water. The rear wheel 3 of the bicycle rests on the drum 22. The user will mount the bicycle 1 and initiate pedaling. The rotation of the drum 22 will start rotating a belt 24 that is positioned around idler pulleys 25, 26, and drive pulley 27. Drive pulley 27 is attached to a flexible drive shaft 28 and the turning of the pulleys will, in turn, drive the shaft and rotate the propeller 29. The propeller 29 is shielded by a propeller protector/rudder 35. This activity will create the forward motion for the apparatus. The steering control pulley 34 and the drive pulley 27 are both positioned on the flexible drive shaft 28.

In operation, the user would remove the front wheel of the bicycle and position the rear wheel on the drive drum. He or she will attach the front fork of the bicycle to the steering control shaft. An adjustable stability rod 30 would then be attached to the rear of the bicycle by means of the quick release mechanisms. The rider can then mount the bicycle and begin to pedal.

While I have described my invention in connection with specific embodiments thereof, it is clearly to be understood that this is done only by way of example and not as a limitation to the scope of my invention as set forth in the objects thereof and in the appended claims.

I claim:

1. A floatation apparatus for use with any standard bicycle, for use in allowing an individual the ability have a self propelled water craft, comprising:

floatation means;

said floatation means comprising means with a sufficient area of buoyancy to allow a standard bicycle and rider to maintain their balance on the surface of the water;

said floatation means having frame means for permitting said bicycle to have a support base;

said frame means comprising means for attaching a bicycle frame to said floatation means;

said support base having an adjustable support frame connected to said base support plate;

said adjustable support frame having guide tracks positioned on said floatation means for allowing said adjustable support frame to slide into the desired position to receive said bicycle frame;

said adjustable support frame further having quick release means;

said frame attaching means having bicycle frame receiving means;

said frame means further having directional control means;

said directional control means comprising a steering control pulley;

said directional control means further comprising adjustable line means looped around said steering control pulley;

said frame means further having drive means;

said drive means comprising means for receiving the rear wheel of a bicycle;

said wheel receiving means comprising a rotatable drum means for permitting said rear wheel of said bicycle positioned on said rotatable drum and allow free rotation of said rear wheel;

said rotatable drum means having transmission means;

said transmission means comprising belt means;

said transmission means further comprising pulley means;

said drive means having a propeller contacting said transmission means through a flexible shaft means; and said flexible shaft means having both said transmission pulley means of said drive means and said steering control pulley of said directional control means positioned on said flexible shaft means.

2. A floatation apparatus for use with any standard bicycle, according to claim 1, wherein:

said floatation means comprises a catamaran unit or dual pontoon hull unit.

3. A floatation apparatus for use with any standard bicycle, according to claim 1, wherein:

said frame means comprises a tubular structure positioned between said floatation means.

4. A floatation apparatus for use with any standard bicycle, according to claim 1, wherein:

said quick release means comprises a clamp mechanism which will allow immediate release of the bicycle when desired.

5. A floatation apparatus for use with any standard bicycle, according to claim 1, wherein:

said directional control means comprises a flexible shaft means controlled by said steering control pulley which is controlled by the movement of the handle bars of said bicycle.

6. A floatation apparatus for use with any standard bicycle, according to claim 1, wherein:

said rotatable drum means have support rods between said floatation means; and said rotatable drum means further having bearing means.

7. A floatation apparatus for use with any standard bicycle, according to claim 1, wherein:

said transmission means comprises a plurality of idler pulleys connected by said belt means to said drum means to said shaft means.

8. A floatation apparatus for use with any standard bicycle, according to claim 1, wherein:

said propeller having protection/rudder means; and said protection/rudder means comprises a shield being positioned in front of said propeller.

* * * * *